US006554529B2

(12) United States Patent
Stephens et al.

(10) Patent No.: US 6,554,529 B2
(45) Date of Patent: Apr. 29, 2003

(54) ENERGY-ABSORBING ASSEMBLY FOR ROADSIDE IMPACT ATTENUATOR

(75) Inventors: Barry D. Stephens, Roseville, CA (US); Michael J. Buehler, Roseville, CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 4 days.

(21) Appl. No.: 09/799,905

(22) Filed: Mar. 5, 2001

(65) Prior Publication Data

US 2002/0154946 A1 Oct. 24, 2002

(51) Int. Cl.[7] ..... G01F 15/00
(52) U.S. Cl. ..... 404/6
(58) Field of Search ..... 404/6

(56) References Cited

U.S. PATENT DOCUMENTS

| | | | | |
|---|---|---|---|---|
| 2,088,087 A | * | 7/1937 | Hudson | 404/6 |
| 3,845,936 A | * | 11/1974 | Boedecker, Jr. et al. | 256/1 |
| 4,200,310 A | | 4/1980 | Carney, III | |
| 4,583,716 A | | 4/1986 | Stephens et al. | |
| 4,635,417 A | * | 1/1987 | Larouche | 52/239 |
| 4,645,375 A | | 2/1987 | Carney, III | |
| 5,011,326 A | | 4/1991 | Carney, III | |
| 5,112,028 A | * | 5/1992 | Laturner | 256/13.1 |
| 5,125,762 A | * | 6/1992 | Strassil | 404/6 |
| 5,403,112 A | | 4/1995 | Carney, III | |
| 5,733,062 A | | 3/1998 | Oberth et al. | |
| 5,875,875 A | * | 3/1999 | Knotts | 188/374 |
| 6,092,959 A | * | 7/2000 | Leonhardt et al. | 404/6 |
| 6,308,809 B1 | * | 10/2001 | Reid et al. | 188/377 |
| 6,398,054 B1 | * | 6/2002 | Overholt et al. | 220/7 |

OTHER PUBLICATIONS

Copy of U.S. patent application Ser. No. 09/753,476 filed on Jan. 3, 2001.

* cited by examiner

*Primary Examiner*—Thomas B. Will
*Assistant Examiner*—Raymond W Addie
(74) *Attorney, Agent, or Firm*—Brinks Hofer Gilson & Lione

(57) ABSTRACT

An energy absorbing assembly for a roadside crash cushion includes a resilient, self-restoring tube and a compression element positioned inside the tube to brace the tube against compression along a compression axis while allowing compression of the tube in other directions. The compression element is mounted to the tube by a hinge having a first portion secured to the tube, a second portion secured to the compression element, and a hinge portion interconnecting the first and second portions. The hinge reduces bending forces on the fasteners that secure the hinge to the tube and to the compression element in an axial impact.

20 Claims, 12 Drawing Sheets

FIG. 16
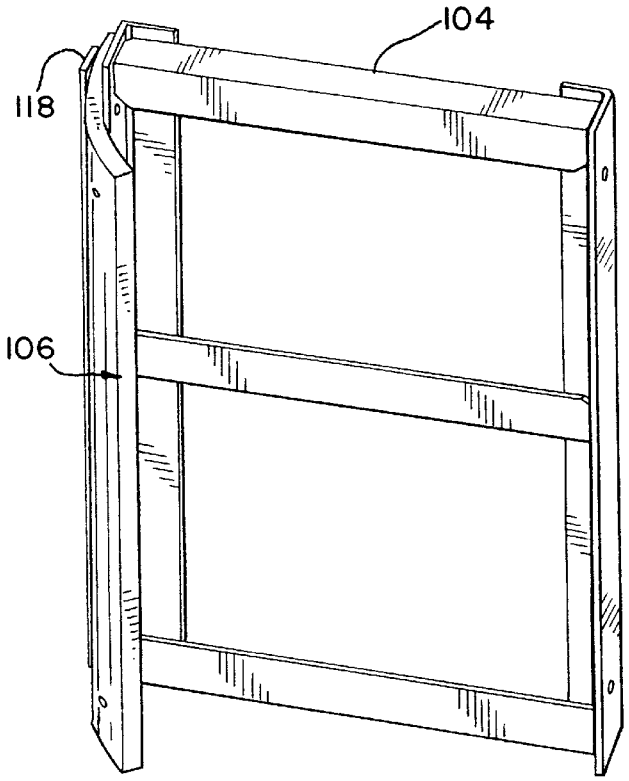
FIG. 17
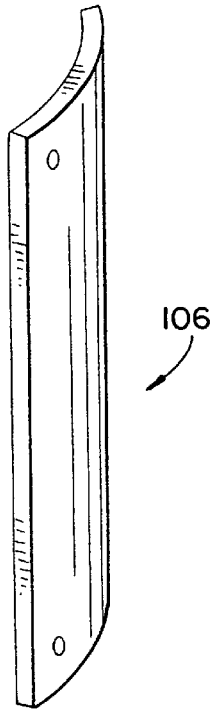
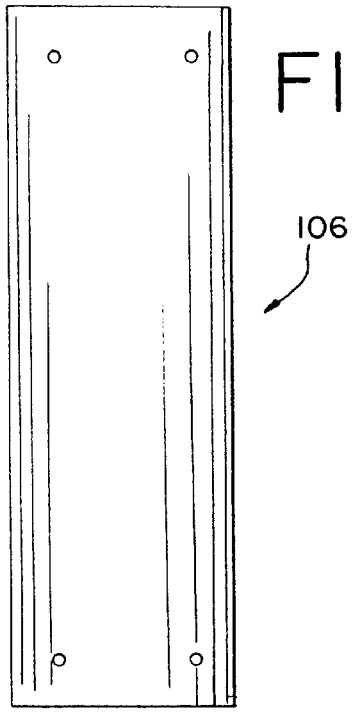
FIG. 18
FIG. 19
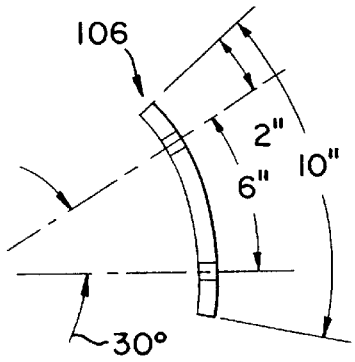

ENERGY-ABSORBING ASSEMBLY FOR ROADSIDE IMPACT ATTENUATOR

BACKGROUND

The present invention relates to impact attenuators for vehicles that have left the roadway, and in particular to such attenuators that are well adapted to bring an axially impacting vehicle to a safe stop and to redirect a laterally impacting vehicle that strikes the side of the attenuator.

Carney U.S. Pat. Nos. 4,645,375 and 5,011,326 disclose two stationary impact attenuation systems. Both rely on an array of vertically oriented metal cylinders. In the '375 patent, compression elements 54 are arranged in selected cylinders transverse to the longitudinal axis of the array. In the '326 patent, the cylinders are guided in longitudinal movement by cables extending alongside the cylinders on both outer faces of the array. The individual cylinders are guided along the cables by eye-bolts or U-bolts.

Stephens U.S. patent application Ser. No. 09/753,476, assigned to the assignee of the present invention and hereby incorporated by reference in its entirety, discloses an improved impact attenuator that redirects vehicles impacting the side of the barrier, and that is more easily restored to working condition after an impact. The disclosed system includes an array of resilient, self-restoring tubes. Each of the tubes is braced by a respective compression element that braces the tube against compression along a respective compression axis, while allowing the tube to be resiliently compressed transverse to this compression axis.

In the preferred embodiments described in the Stephens application, the compression element is oriented at an acute angle with respect to the longitudinal axis of the array. In an axial impact, the tubes are both collapsed along the axial direction and twisted as the compression elements are reoriented perpendicular to the longitudinal direction. The associated stresses can on occasion bend the fasteners that secure the compression elements to the tubes, which may complicate the process of restoring the impact attenuator for reuse after an impact.

A need presently exists for an improved energy absorbing assembly of the type including a tube and an internal compression element that is less subject to this disadvantage.

SUMMARY

By way of introduction, the energy absorbing assemblies described below include a resilient, self-restoring tube, a compression element positioned inside the tube to brace the tube against compression along a compression axis, and a hinge including a first portion secured to the tube, a second portion secured to the compression element, and a hinge portion interconnecting the first and second portions. The hinge allows movement of the compression element relative to the tube when the tube is collapsed along a crush axis. This reduces bending forces on the associated fasteners and substantially reduces or eliminates the incidence of bent fasteners.

One preferred embodiment described below uses a living hinge formed of a strip of the same polymeric material as that used to form the tube. Such a living hinge provides the advantage that the compression element is automatically biased back to its original position once the array has been restored to its original configuration after an impact.

The foregoing paragraph has been provided by way of general introduction, and it should not be used to narrow the scope of the following claims.

BRIEF DESCRIPTION OF THE DRAWINGS

FIG. 16 is a perspective view of the compression element and hinge of the energy absorbing assembly of FIG. 14.

FIGS. 17, 18 and 19 are perspective, front, and top views, respectively, of the hinge of FIG. 16.

DETAILED DESCRIPTION OF THE PRESENTLY PREFERRED EMBODIMENTS

The following detailed description will first describe preferred embodiments of the energy absorbing assembly of this invention, before turning to several alternative impact attenuators in which this energy absorbing assembly can be used.

PRESENTLY PREFERRED ENERGY ABSORBING ASSEMBLIES

Figure 14:
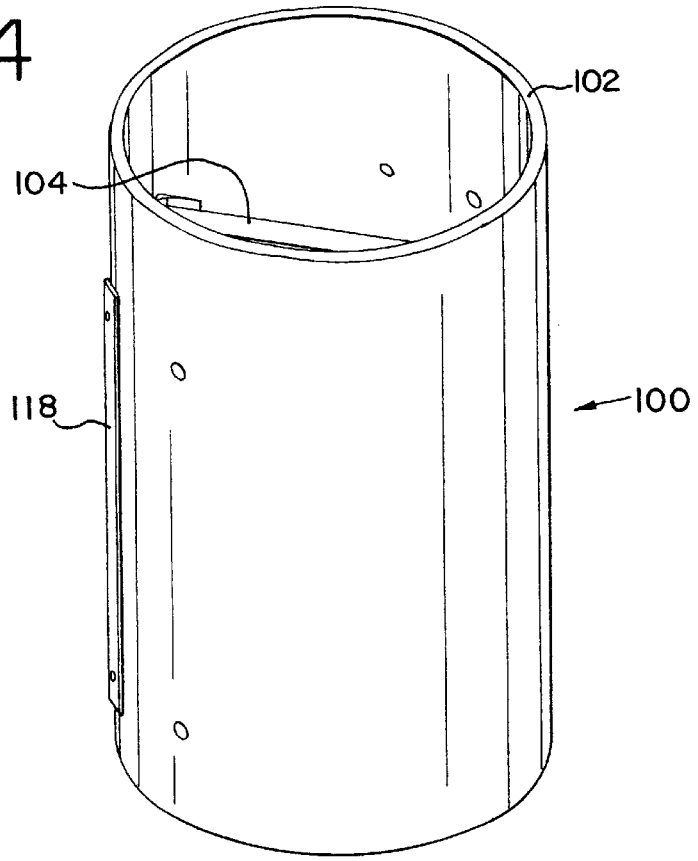
FIG. 14 is a perspective view of an energy absorbing element that incorporates a first preferred embodiment of this invention.
Figure 15:
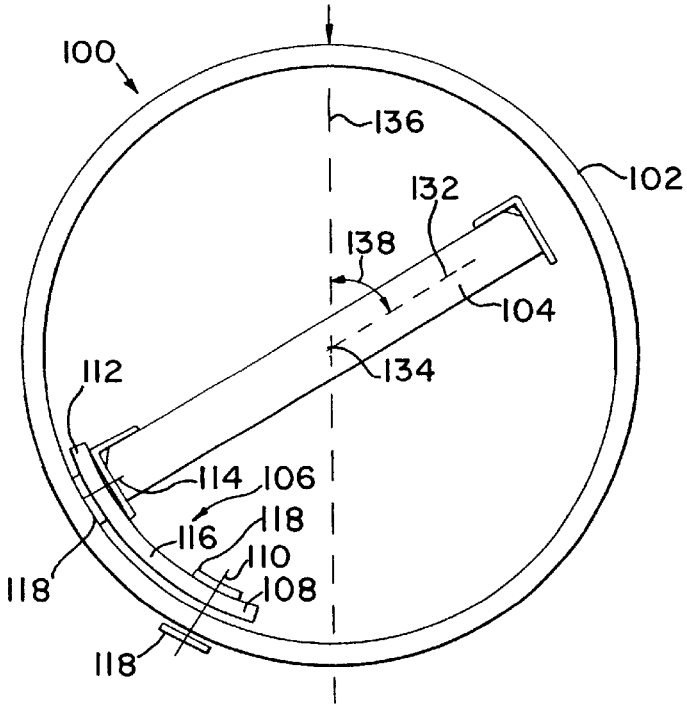
FIG. 15 is a top view of the energy absorbing element of FIG. 14.

Turning now to FIGS. 14–22, various preferred embodiments of the energy absorbing assembly of this invention are shown. FIGS. 14–20*d* relate to a first energy absorbing element 100. As best shown in FIG. 15, the energy absorbing assembly 100 includes a tube 102, a compression element 104, and a hinge 106. The preferred assembly 100 is symmetrical, with no specified top or bottom through asymmetrical arrangements are also within the scope of this invention.

The tube 102 is formed of a resilient, self-restoring, polymeric material such as high density polyethylene (HDPE). The tube 102 deforms resiliently in response to compressive loads extending along a diameter of the tube, thereby providing forces that tend to slow an impacting vehicle. The resiliency of the tube restores the tube substantially to the original configuration after many impacts. Further details regarding alternative forms of the tube 102 are described in the following section relating to preferred impact attenuations.

The compression element 104 in this embodiment is formed as a rectangular frame welded from metal elements, each of which has an L-shape in cross-section. Other cross sections can be used, including but not limited to rectangular, channel, round, and other structural shapes. The compression element 104 in this embodiment is generally planar, and it is positioned by the hinge 106 approximately along a diameter of the tube 102. The compression element 104 braces the tube 102 against compression in the plane of the compression element 104, while allowing substantial compression of the tube 102 in other directions. The compression element 104 can be varied widely, and all of the alternative constructions described below in the section relating to preferred impact attenuations can be used.

As best shown in FIGS. 17–19, the hinge 106 in this embodiment is a strip of resilient self-restoring polymeric material. This material may be identical to the material from which the tube 102 is formed. One non-limiting example of a suitable polymeric material for both the tube 102 and the hinge 106 is high density polyethylene (HDPE) such as PE 3408 with an SDR of 32.5. In this embodiment the hinge 106 is of substantially constant thickness, and the hinge 106 does not define a predetermined hinge axis. The hinge 106 can be taken as an example of a living hinge. Alternatively, weakened areas can be provided on the strip of material to provide predetermined hinge axes. Simply by way of example, FIG. 19 provides preferred dimensions for the hinge 106. Of course, these preferred dimensions are only intended by way of illustration, and they in no way are intended to limit the scope of this invention.

As shown in FIG. 15, the hinge 106 includes a first portion 108 that is secured to the tube 102 by first fasteners 110, and a second portion 1 12 that is secured to the compression element 104 (but not the tube 102) by second fasteners 114. The hinge 106 also includes a hinge portion 1 16 that is interposed between the first and second portions 108, 112. In FIG. 15, the fasteners 110, 114 are shown schematically as lines. In actual practice, the fasteners 110, 114 are generally implemented as threaded fasteners, such as ½ inch hex-head cap screws and nuts (e.g., Grade 5). Washer plates 116 are provided between the fasteners 110, 114 and the hinge 106 as well as between the fasteners 110 and the tube 102 to reduce the incidence of fastener tearout. FIG. 14 shows a perspective view of one of these washer plates 118.

By way of example, the energy absorbing assembly 100 of FIG. 14 can be assembled by first securing the hinge 106 to the compression element 104 with the second fasteners 114, thereby creating the subassembly of FIG. 16. This subassembly can then be inserted into the tube 102 and then secured to the tube 102 with the fasteners 110.

FIGS. 20*a*–20*d* illustrate operation of the hinge 106. These figures show the energy absorbing assembly 100 at successive stages of collapse along a crush axis 136 that is oriented parallel to a central longitudinal axis 130 of an array (not shown) in which the assembly 100 is included. Each of the tubes 102 defines a respective centerline 134, and the crush axis 136 extends through the centerline 134. Note that the entire assembly 100 is positioned to one side of the central longitudinal axis 130. Each of the compression elements 104 defines a respective compression axis 132, and the compression axes 132 in this example are oriented at an acute angle 138 such as 60° with respect to the central longitudinal axis 130.

Figure 20A:
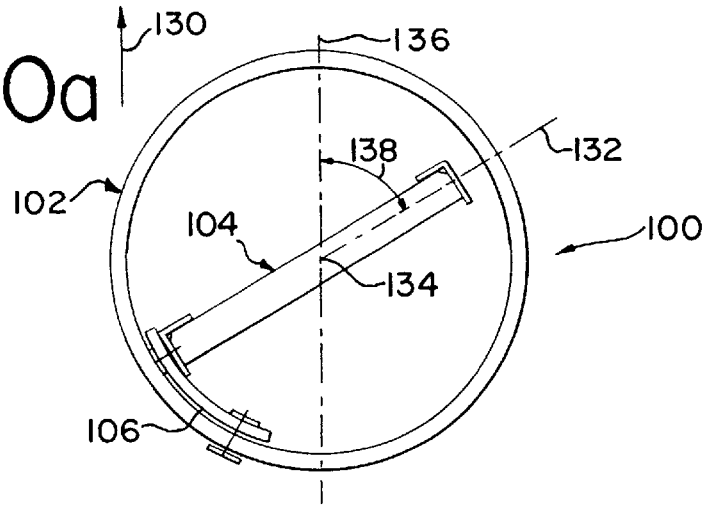
FIGS. 20*a*, 20*b*, 20*c*, and 20*d* show the energy absorbing element of FIG. 14 in successive stages of collapse along the crush axis, showing the action of the hinge.
Figure 20B:
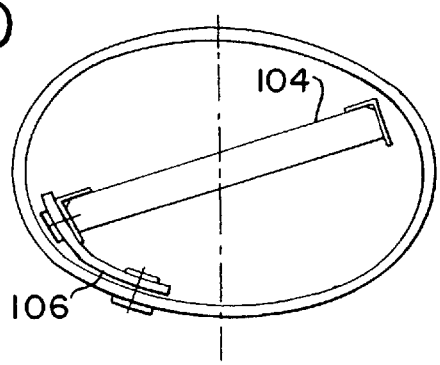
Figure 20C:
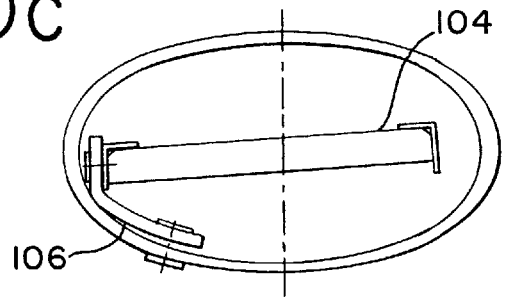
Figure 20D:
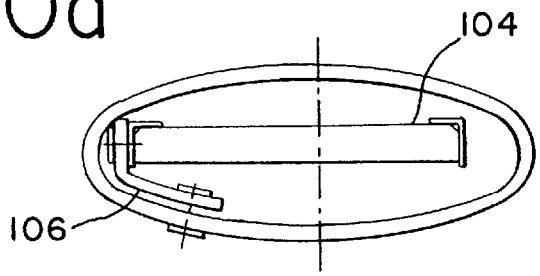
Figure 21:
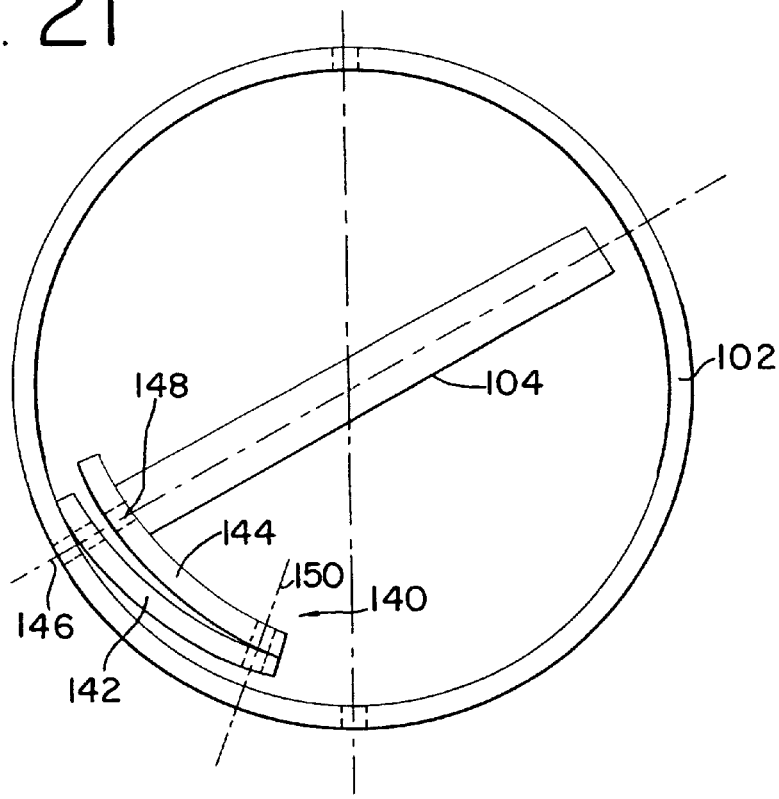
FIG. 21 is a top view of a second preferred embodiment of the energy absorbing assembly of this invention, showing an alternative hinge.

As shown in FIG. 20*a*, prior to an axial impact the hinge 106 holds the compression element 104 in the desired position, in which the compression element 104 passes through the centerline 134 and is oriented at the acute angle 138 with respect to the central longitudinal axis 130 of the array. In an axial impact the energy absorbing assembly 100 is crushed along the crush axis 136 as shown progressively in FIGS. 20*b*, 20*c* and 20*d*. As the tube 102 is crushed, the compression element 104 is rotated from its original position as shown in FIG. 20*a* to its final position, in which the compression element 104 is oriented transverse to the crush axis 136. The hinge 106 accommodates this rotation of the compression element 104, while reducing bending forces on the fasteners that secure the hinge 106 to the compression element 104 and to the tube 102.

After an axial impact of the type schematically shown in FIGS. 20*a* through 20*d*, the array can be restored to its original position, and the resiliency of the tube 102 and the hinge 106 will substantially or completely restore the tube 102 to the shape of FIG. 20*a* and the compression element 104 to the position of FIG. 20*a*. Since the fasteners securing the hinge 106 in place are seldom bent or otherwise deformed, the energy absorbing assembly 100 can be compressed a number of times without the need for repair. However, when repairs are eventually required, disassembly of the energy absorbing assembly 100 is a simple matter.

The hinge 106 can take many alternative forms. In the alternative shown in FIG. 21, the hinge 140 includes first and second leafs 142, 144. Only the leaf 142 is secured to the tube 102 by first fasteners 146, and only the leaf 144 is secured to the compression element 104 by second fasteners 148. The two leafs 142, 144 are secured together by third fasteners 150. In this example, the hinge 140 is formed of a resilient, self-restoring polymeric material such as that described above, and it provides all of the advantages of the hinge 106. However, in this case the fasteners 146, 148 are not circumferentially offset with respect to one another around the tube 102.

Figure 22:
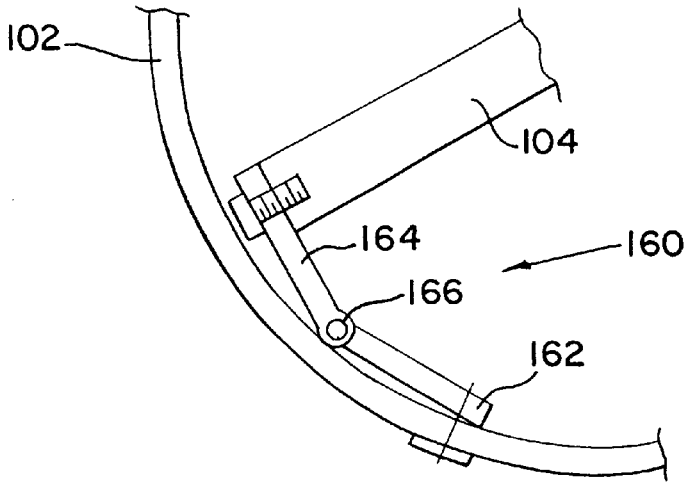
FIG. 22 is a fragmentary top view of a third preferred embodiment of the energy absorbing assembly of this invention, showing another alternative hinge.

FIG. 22 shows another alternative, in which the compression element 104 is secured to the tube 102 by a hinge 160 that includes hinge leafs 162, 164 that are mounted to pivot with respect to one another about a hinge pin 166. The hinge 160 functions similarly to the hinge 106 described above, except that the hinge 106 is not a living hinge. Also, typically a spring system such as a torsion spring (not shown) about the hinge pin 166 is used to provide the desired restoring force tending to restore the compression element 104 to its original position after an impact. The hinge leafs 162, 164 can be formed of any suitable material, including polymeric materials and metal alloys.

The energy absorbing assembly 100 described above can be used in a wide variety of impact attenuators, including without limitation the impact attenuators described in the following section.

PRESENTLY PREFERRED IMPACT ATTENUATORS UTILIZING THE ENERGY ABSORBING ASSEMBLIES OF FIGS. 14 THROUGH 22

Figure 1:
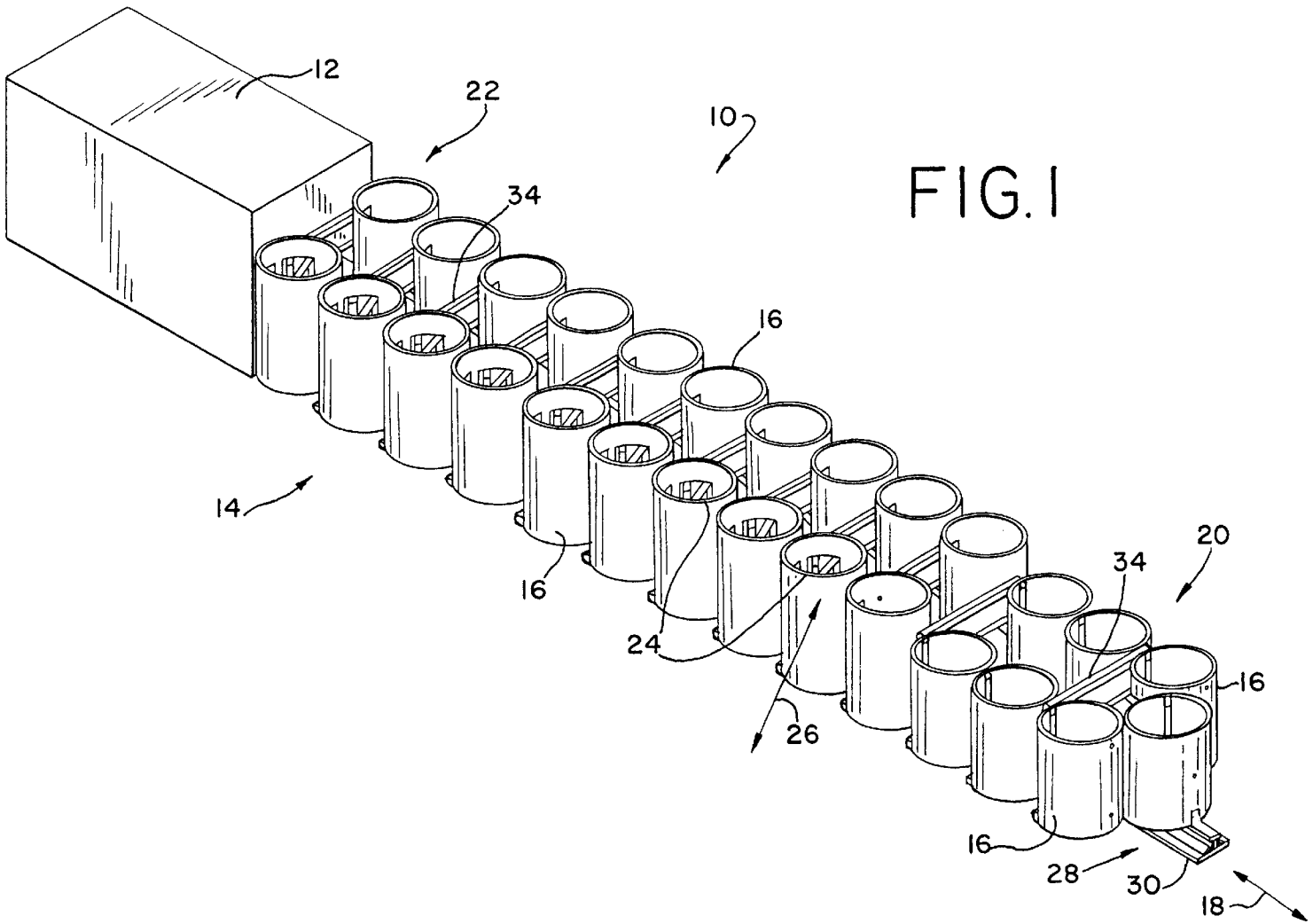
FIG. 1 is a perspective view of an impact attenuator.

FIG. 1 shows an overall view of a vehicle impact attenuator 10 in an initial condition, prior to impact. The attenuator 10 is shown positioned forwardly of a backup 12, which can be any hazard alongside a roadway from which vehicles are to be protected. For example, the backup 12 can be a bridge pier, a wall, or other obstruction positioned alongside the roadway.

The attenuator 10 includes an array 14 of tubes 16. In this embodiment, all of the tubes 16 are cylindrical in shape, and they are oriented with their cylinder axes positioned vertically. The tubes 16 are preferably formed of a resilient, polymeric material, such as high density polyethylene (HDPE), such that the tubes 16 are self-restoring after an impact. As used herein, the term "self-restoring" signifies that the tubes return substantially (though not in all cases completely) to their original condition after at least some impacts. Thus, the tube does not have to return to exactly its original condition to be considered self-restoring.

The array 14 defines a longitudinal axis 18 extending forwardly from the backup 12, and the array 14 includes a front end 20 positioned farther from the backup than the back end 22.

As described in greater detail below, the tubes 16 are secured together and to the backup 12, and at least the majority of the array 14 includes rows of the tubes 16, each row having at least two tubes. In this example, each of the rows includes two adjacent tubes, each disposed on a respective side of the longitudinal axis 18. Each of these tubes includes a compression element 24 that is designed to resist compression of the respective tube 16 along a respective compression axis 26, while allowing elongation of the tube 16 along the same axis 26 and collapse of the tube along the longitudinal axis of the array.

In this embodiment, an elongated structure 28 takes the form of a rail 30 that is secured in place in alignment with the longitudinal axis 18, for example, by bolting the rail 30 to the support surface. This rail may take the form of the rail described in U.S. Pat. No. 5,733,062, assigned to the assignee of the present invention and hereby incorporated by reference. The attenuator 10 also includes a plurality of guides 32. In this embodiment, each of the guides 32 includes a transverse element 34 that is secured to adjacent ones of the tubes 16 and is configured to slide along the length of the rail 30, in an axial impact.

In an axial impact, the transverse elements 34 slide along the rail 30, and the tubes 16 are flattened along the longitudinal direction. Deformation of the tubes 16 absorbs kinetic energy and decelerates the impacting vehicle.

In a lateral impact, the compression elements 24 transfer compressive loads to the transverse elements 34, which in turn transfer these compressive loads to the rail 30. This provides substantial lateral stiffness to the attenuator 10 such that the attenuator 10 redirects an impacting vehicle that strikes the attenuator 10 laterally. Because the guides 32 and the elongated structure 28 are positioned inboard of the outer surfaces of the tube, a vehicle traveling down the side of the attenuator 10 encounters few snagging surfaces that might adversely affect the stability or trajectory of the impacting vehicle.

Figure 2:
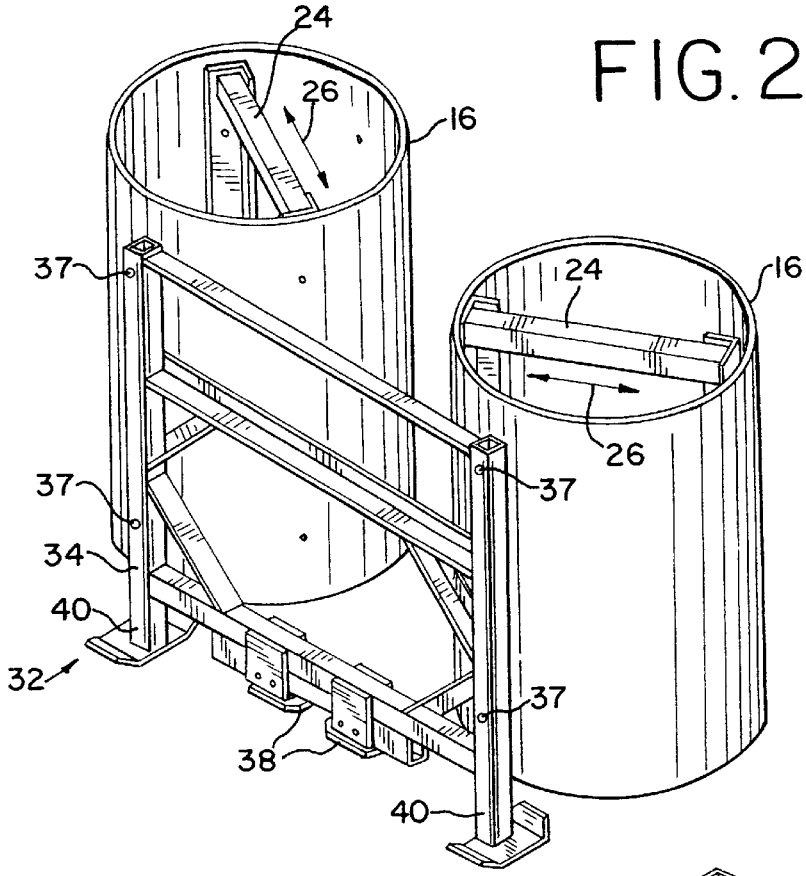
FIG. 2 is a perspective view of a pair of tubes and associated guide and compression elements of the attenuator of FIG. 1.

FIG. 2 provides a more detailed view of selected elements of the attenuator 10. Note that the transverse element 34 in this embodiment is shaped as a frame with substantial stiffness, and that it is provided with plates 38 shaped to fit under an uppermost flange of the rail 30 (FIG. 1) such that the transverse element 34 is restrained from all translation other than axial sliding movement along the length of the rail 30. Each transverse element includes one or more legs 40 that rest on the support surface outboard of the rail. In the event of a lateral impact, the leg on the side of the rail opposite the impact cooperates with the plates 38 and the rail 30 to resist rotation and lifting of the transverse element 34. Preferably, the plates 38 are shaped to allow twisting of the transverse element 34 about a vertical axis over a desired range (e.g., ±25°) to reduce binding with the rail 30.

Figure 3:
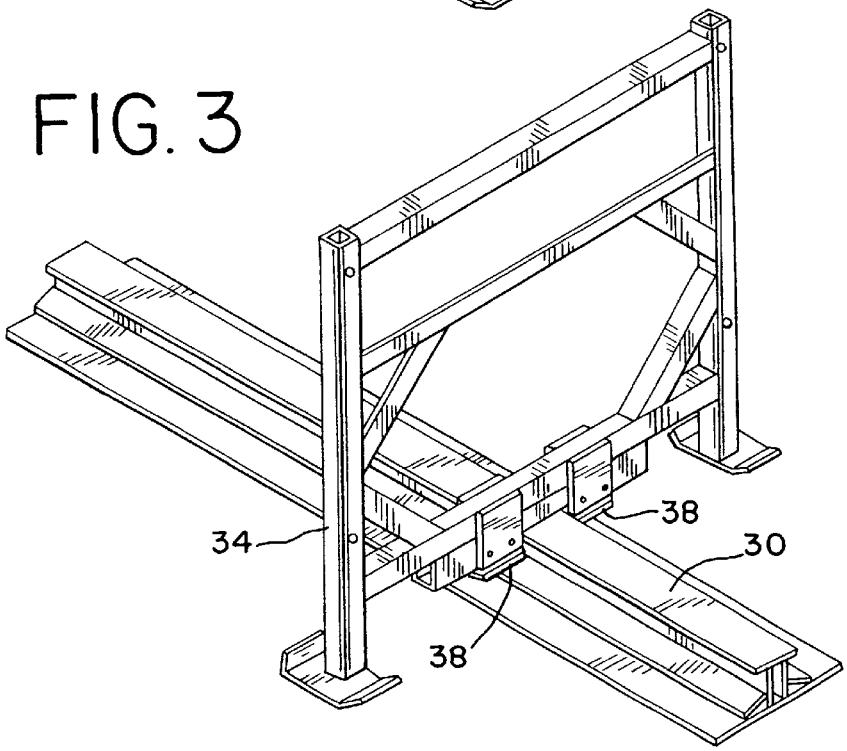
FIGS. 3, 4, 4*a*, and 5 are perspective, enlarged elevation, perspective, and plan views, respectively, showing portions of one of the transverse elements of FIG. 1.
Figure 4:
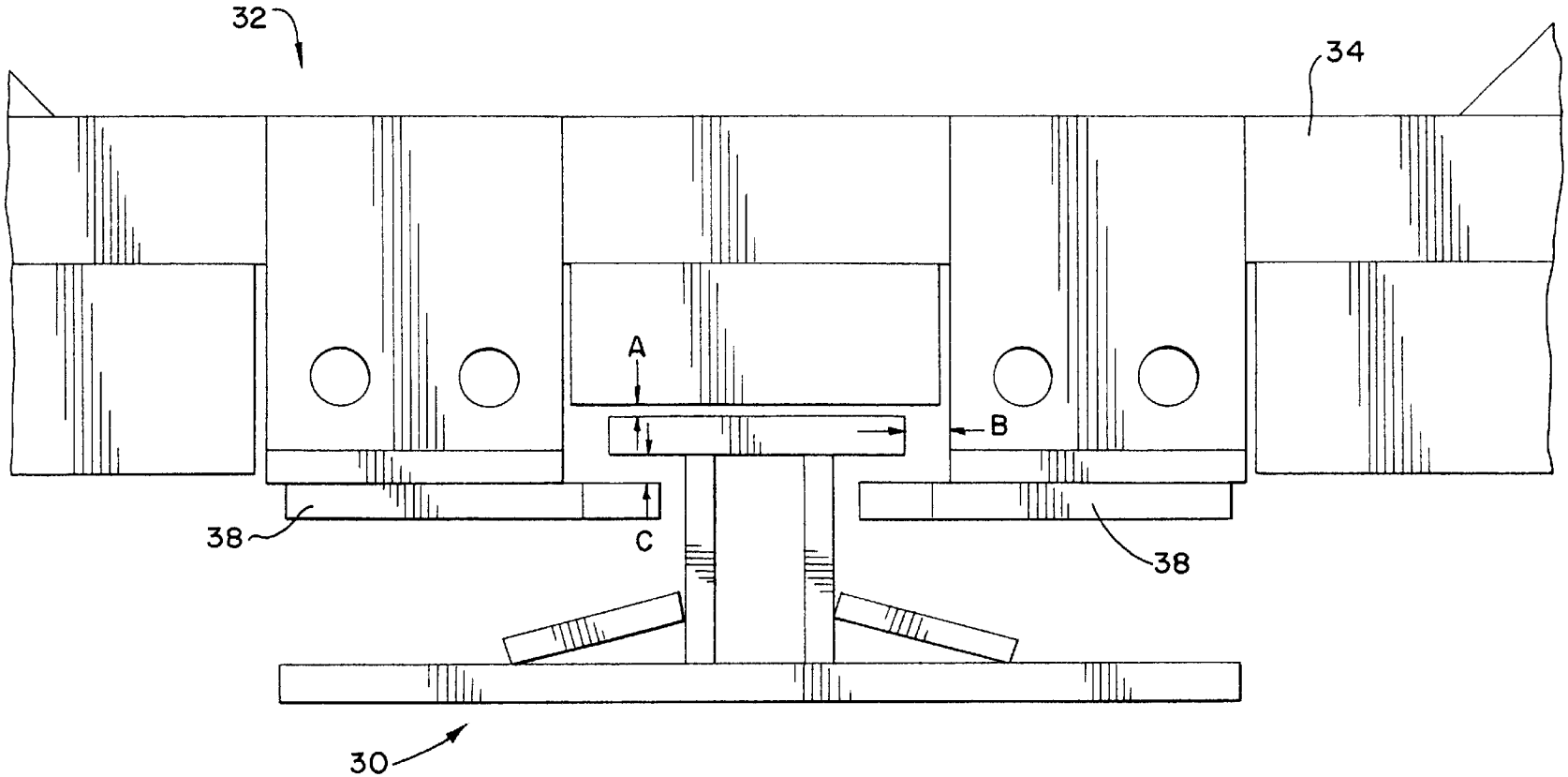
Figure 4A:
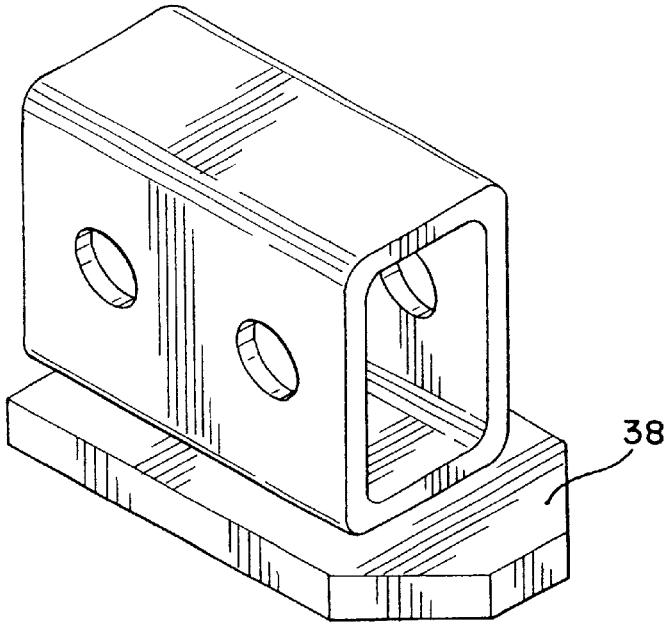

FIGS. 3 and 4 show details of construction of the plates 38 and the rail 30. Note that the fit between the plates 38 and the rail 30 is loose, and this fit allows the desired degree of twisting of the transverse element without binding. The range of allowed twisting is preferably greater than ±10°, more preferably greater than ±20°, and most preferably about ±25°, all measured with respect to the longitudinal axis of the rail 30. The dimensions of Table 1 have been found suitable in one example, in which the plates 38 were shaped as shown in FIG. 4*a*, and the plates 38 extended 7.6 cm along the rail (including the chamfered corners).

TABLE 1

| Parameter | Dimension (cm) |
|---|---|
| A | 0.47 |
| B | 1.59 |
| C | 1.11 |

Figure 5:
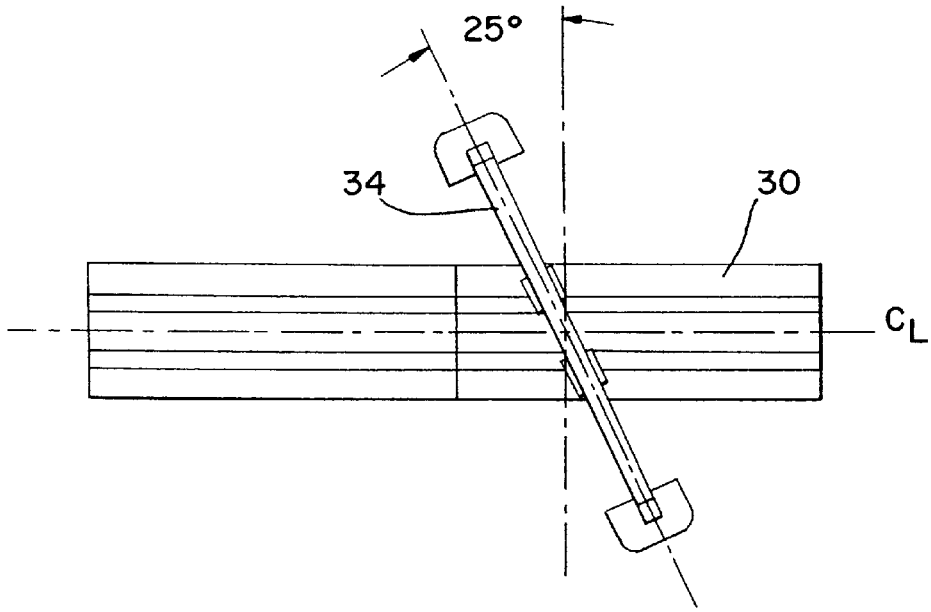

FIG. 5 shows one of the transverse elements 34 twisted by 25° with respect to the rail 30. Many alternatives are possible, including other shapes for the plates 38. For example, the plates 38 may present a curved bullet nose to the rail.

This approach can be used in vehicle impact attenuators of other types, e.g., the attenuator of U.S. Pat. No. 5,733,062, and a wide variety of energy absorbing elements can be used between the transverse elements, including sheet metal elements, foam elements, and composite elements of various types. See, e.g. the energy absorbing elements of U.S. Pat. Nos. 5,733,062, 5,875,875, 4,452,431, 4,635,981, 4,674,911, 4,711,481 and 4,352,484.

Figure 6:
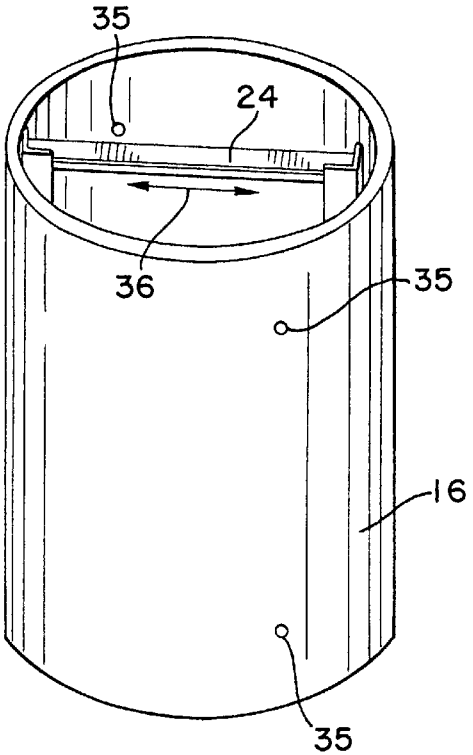
FIG. 6 is a perspective view of one of the tubes of FIG. 1, showing the internal compression element.

As shown in FIG. 2, the tubes 16 are each secured in two places to each adjacent transverse element 34, as for example by suitable fasteners such as bolts passing through the holes 37. Also as shown in FIG. 6, each of the compression elements 24 is secured at one end only to the respective tube 16, as for example by suitable fasteners such as bolts. Each compression element 24 extends substantially completely across the respective tube 16 in the initial condition (e.g., by more than about 80% of the tube diameter), and it is designed to resist compression while allowing extension of the tube 16 along the compression axis 26. As shown in FIG. 6, one end of each of the compression elements 24 is free of tension-resisting attachment to the respective tube 16.

Figure 7:
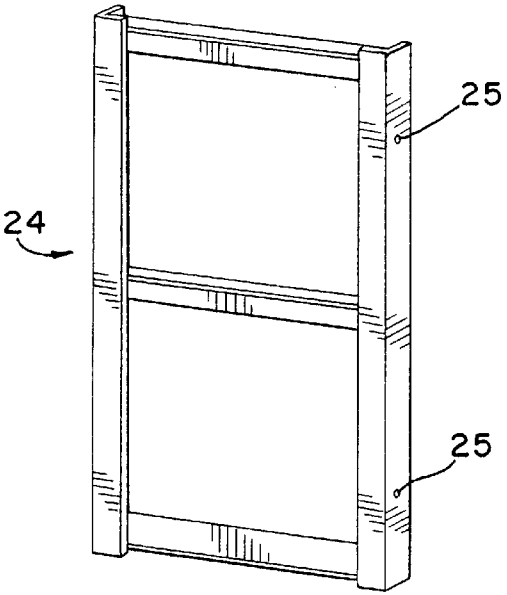
FIG. 7 is a perspective view of the compression element of FIG. 6.

FIG. 6 shows a perspective view of one of the tubes 16 and the associated compression element 24. The compression element 24 is shown in greater detail in FIG. 7. As shown in FIG. 7, the compression element 24 is shaped as a frame in this embodiment, and the compression element includes openings 25 that receive fasteners (not shown) that secure one end only of each compression element 24 to the respective tube 16.

Though FIG. 2 shows only two tubes 16 secured to the transverse element 34, when fully assembled there are a total of four tubes 16 secured to each of the transverse elements 34: two on one side of the rail 30, and two on the other. Thus, each tube 16 is bolted in place between two adjacent transverse elements 34. This arrangement is shown in FIG. 1.

In the event of an axial impact, the impacting vehicle first strikes the front end 20. The momentum of the impacting vehicle causes the transverse elements 34 to slide along the rail 30, thereby compressing the tubes 16 such that they become elongated transverse to the longitudinal axis and flattened along the longitudinal axis. In order to prevent any undesired binding, it is preferred that the tubes 16 within any given row be spaced from one another in an initial condition, e.g., by about one-half the diameter of tubes 16. After the impact, the system can be restored to its original configuration by pulling the forward transverse element 34 away from the backup 12. In many cases, nothing more is required by way of refurbishment.

In the event of a lateral impact at a glancing angle, e.g. 20°, the impacting vehicle will strike the side of the array 14. The compression elements 24 transfer compressive loading to the transverse elements 34, which transfer this compressive loading to the rail 30. In this way, the attenuator 10 provides substantial lateral stiffness and effective redirection of an impacting vehicle.

In the preferred embodiment described above, the orientation of the compression elements at approximately 60° with respect to the longitudinal axis of the array has been found to provide advantages in terms of improved vehicle redirection. In this configuration, the outboard end of each compression element is positioned forwardly of the inboard end of each compression element, at the illustrated angle with the longitudinal axis. Of course, other angles can be used.

In the embodiment of FIGS. 1–7, the array 10 may have a length of 9.1 meters, and each of the tubes may have a height of 102 cm and a diameter of 61 cm. The tubes 16 may be formed of Extra High Molecular Weight Polyethylene resin (e.g., EHMW PE 408 ASTM F714) with a wall thickness of 1.875 (for tubes 16 at the front of the array) and 2.903 cm (for tubes 16 at the rear of the array), all as specified by ASTM F714. All of these dimensions may be varied to suit the particular application.

Figure 8:
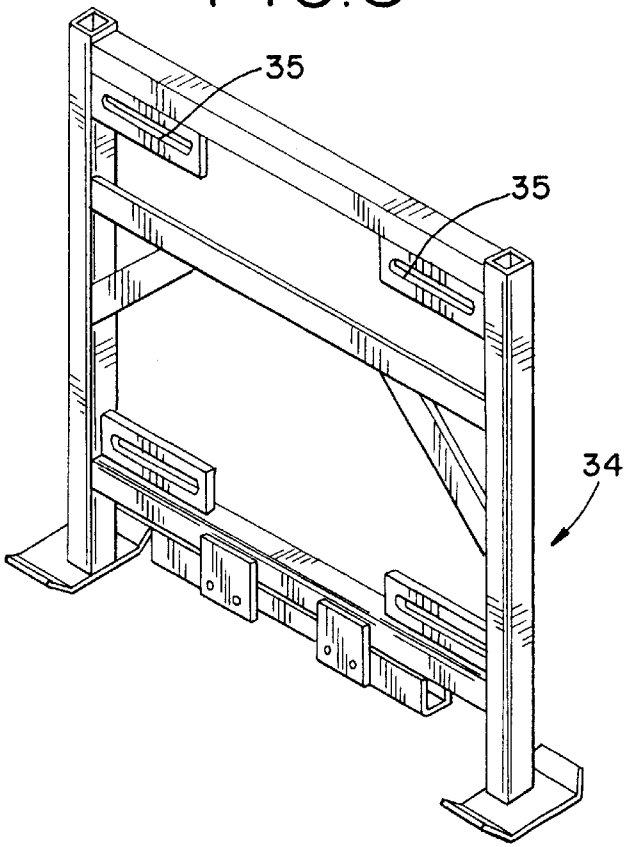
FIG. 8 is a perspective view of portions of an alternative guide that allows sliding attachment between the guide and the adjacent tubes.

Of course, many alternatives are possible to the preferred embodiment described above. FIG. 8 shows an alternative form of the transverse element 34. In this alternative, the transverse element 34 is provided with slots positioned to receive the fasteners that secure the tubes to the transverse element. The slots 35 allow the tubes to move laterally outwardly as necessary during an axial impact to prevent any undesired binding between the tubes within a row at the centerline.

Figure 9:
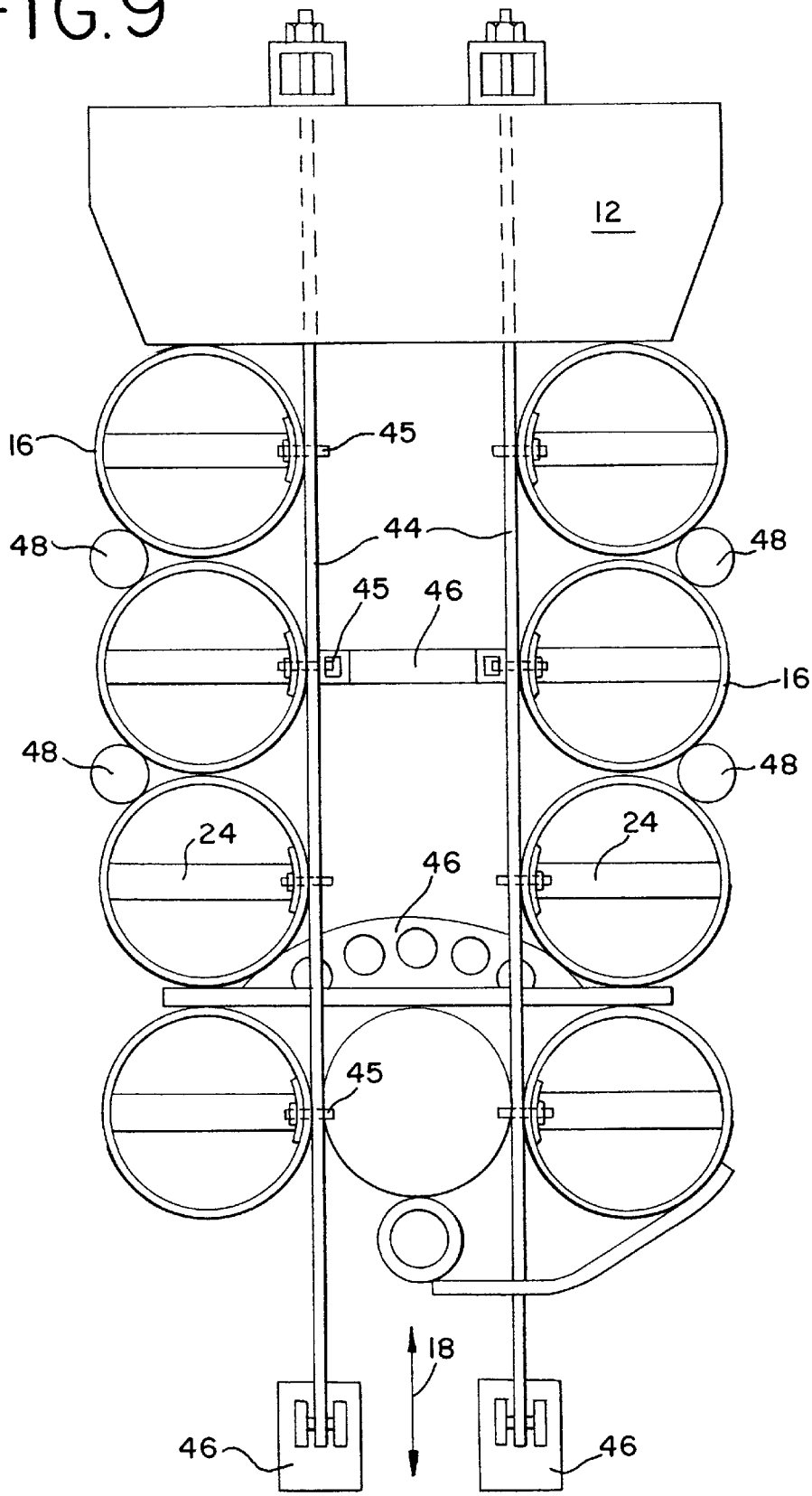
FIG. 9 is a top view of a second impact attenuator.

FIG. 9 relates to another alternative embodiment in which the elongated structure that provides lateral rigidity is implemented as a set of cables 44. These cables 44 are positioned to support a central portion of the tubes 16, and the tubes 16 are secured to the cables 44 by means of guides 45 that may take the form of eye-bolts or U-bolts. In this example, the compression elements 24 are positioned transversely to the longitudinal axis 18 and are secured to the guides 45. Load-sharing diaphragms 46 are provided to transfer lateral loads from one of the cables to the other. The cables are anchored rearwardly to the backup 12 and forwardly to ground anchors 46. If desired, extra redirecting cylinders 48 may be positioned between the tubes 16.

Figure 10:
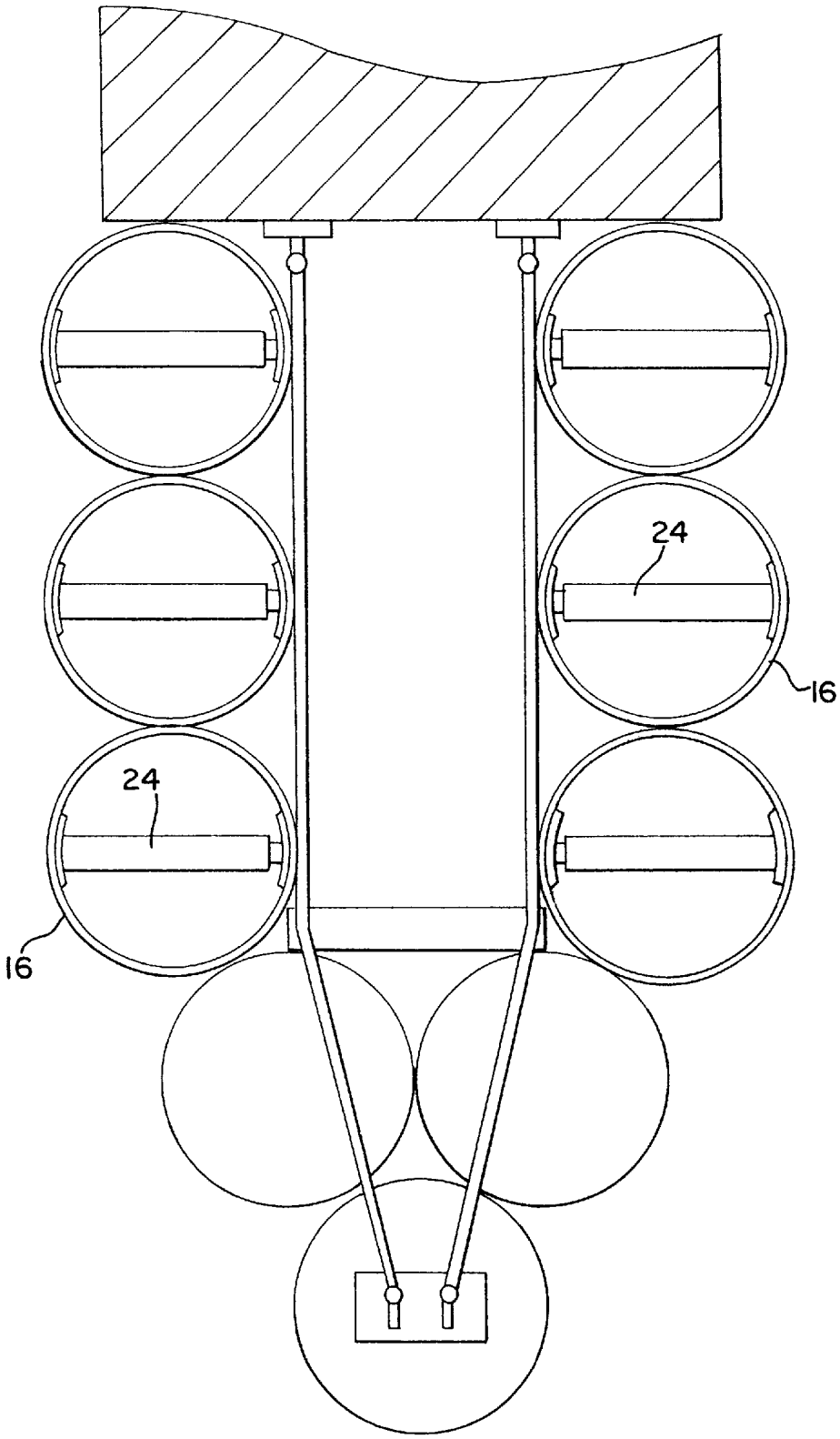
FIGS. 10 and 11 are top views of a third impact attenuator, before and after axial compression, respectively.
Figure 11:
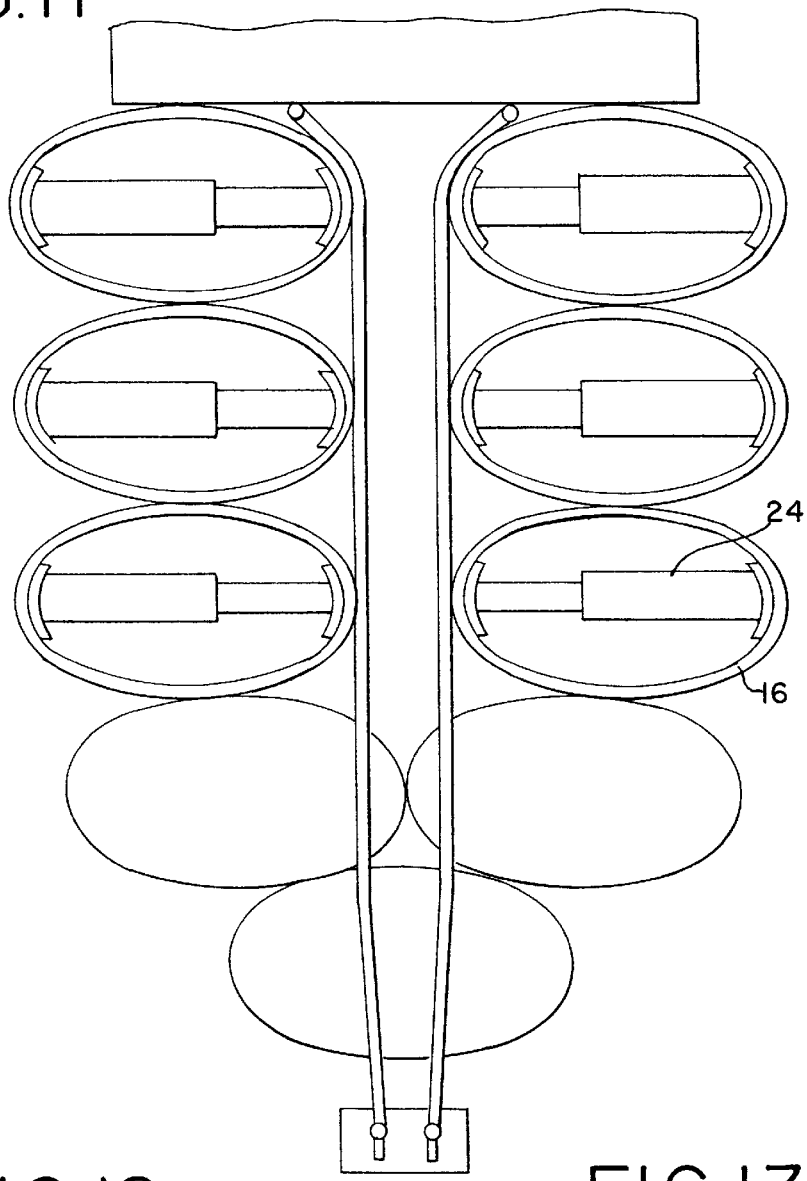

FIGS. 10 and 11 relate to a third embodiment that is similar to the embodiment of FIG. 9 in many ways. FIG. 10 shows the system prior to impact with a vehicle, and FIG. 11 shows the system following an axial impact. Note that the compression elements 24 are designed to resist collapse of the tubes 16 in the lateral direction, while allowing expansion of the tubes 16 in the lateral direction.

Figure 12:
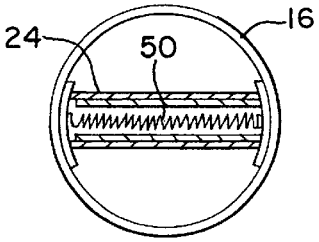
FIGS. 12 and 13 are top views of one of the cylinders of FIGS. 10 and 11 and the associated compression element, before and after axial compression, respectively.
Figure 13:
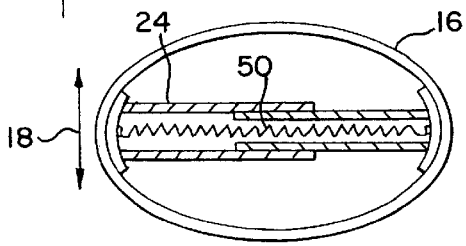

The embodiment of FIGS. 10 and 11 uses a modified compression element 24 that is telescoping and is secured at both ends to the tube 16. FIG. 12 shows the telescoping compression element in its initial condition, and FIG. 13 shows the telescoping compression element during an axial impact when the tube 16 is elongated. If desired a tension spring 50 can be provided to restore the distorted tube 16 to the initial condition of FIG. 12 after an impact. The telescoping compression element of these figures can be used in any of the embodiments described above.

Of course, many changes and modifications can be made to the preferred embodiments described above. For example, when the elongated structure is implemented as a rail, two or more rails can be used rather than the single rail described above. The tubes 16 can be formed of a wide variety of materials, and may be non-circular in cross section (e.g. rectangular, oval, or triangular). The compression elements can be shaped either as frames or struts, as described above, or alternately as panels or other shapes designed to resist compression effectively. In some cases, a single compression element can be placed within each tube. In other cases, multiple compression elements may be placed within each tube, for example at varying heights.

Similarly, the guides described above can take many forms, including guides adapted to slide along a cable as well as guides adapted to slide along one or more rails. The guides may or may not include transverse elements, and if so the transverse elements may be shaped differently than those described above. For example, rigid panels may be substituted for the disclosed frames.

As another alternative, a separate guide may be provided for each tube rather than having a single transverse element to which multiple tubes are mounted. Also, there may be a smaller ratio of guides to tubes such that some of the tubes are coupled only indirectly to one or more guides (e.g. via intermediate tubes). In this alternative, two or more tubes that are spaced along the longitudinal axis of the array may have no guide therebetween.

The angle of the compression axes, the number of transverse elements 34 per system, the number of tubes per system, the location of the compression elements within the tubes, and the number of compression elements per tube may all be varied as appropriate for the particular application. Also, it is not essential that every tube include a compression element or that every tube be directly connected to a guide, and selective use of compression elements and/or guides with only some of the tubes is contemplated.

As used herein, the term "tube" is intended broadly to encompass tubes of any desired cross-section. Thus, a tube does not have to be circular in cross-section as in the illustrated embodiment.

The term "set" is used in its conventional way to indicate one or more.

The term "compression element" is intended to encompass a wide variety of structures that effectively resist compressive loads along a compression axis while allowing substantial compression in at least some other directions.

The foregoing detailed description has discussed only a few of the many forms that this invention can take. For this reason, this detailed description is intended by way of illustration, and not limitation. It is only the following claims, including all equivalents, that are intended to define the scope of this invention.

What is claimed is:

1. An energy absorbing assembly for a roadside crash cushion, said assembly comprising:

a resilient, self-restoring tube;

a compression element positioned inside the tube to brace the tube against compression along a compression axis defined by the compression element while allowing compression of the tube in at least some other directions; and a hinge comprising a first portion secured to the tube, a second portion secured to the compression element, and a hinge portion interconnecting the first and second portions, wherein said first and second portions are moveable relative to each other about said hinge portion when said tube is compressed in said at least some other directions.

2. The invention of claim 1 wherein the hinge comprises a single strip of resilient, self-restoring material, and wherein the single strip of material comprises the first, second, and hinge portions.

3. The invention of claim 1 wherein the hinge portion comprises a living hinge.

4. The invention of claim 1 wherein the hinge portion comprises a hinge pin.

5. The invention of claim 1 wherein the hinge extends generally alongside the tube.

6. The invention of claim 1 wherein the first portion is secured to the tube by first fasteners, wherein the second portion is secured to the compression element by second fasteners, and wherein the hinge portion is interposed between the first and second fasteners.

7. The invention of claim 1 wherein the tube is secured in place in a roadside crash cushion, said roadside crash cushion comprising a central longitudinal axis, said tube positioned entirely on one side of the longitudinal axis.

8. The invention of claim 7 wherein the compression axis defines a non-zero acute angle with respect to the longitudinal axis.

9. The invention of claim 8 wherein the acute angle is about 60°.

10. The invention of claim 7 wherein the tube defines a centerline, wherein the crash cushion defines a crush axis oriented parallel to the longitudinal axis of the roadside crash cushion and passing through the centerline of the tube, and wherein the crush axis is closer to the first portion of the hinge than to the second portion of the hinge.

11. The invention of claim 1 wherein the tube consists essentially of a polymeric material.

12. The invention of claim 11 wherein the hinge consists essentially of a polymeric material.

13. The invention of claim 1 wherein said compression element comprises a first end secured to said second portion of said hinge and a second end opposite said first end, and wherein said second end is free from any connection to said compression element.

14. A method for absorbing the impact of a vehicle with a crash cushion comprising:

providing an energy absorbing assembly comprising a resilient, self-restoring tube, a compression element positioned inside the tube and defining a compression axis, and a hinge connecting said compression element and said tube;

impacting said energy absorbing assembly along a crush axis, wherein said crush axis is substantially non-parallel to said compression axis;

compressing said tube along said crush axis; and pivoting said compression element about said hinge.

15. The method of claim 14 wherein said hinge comprises a first portion secured to the tube, a second portion secured to the compression element, and a hinge portion interconnecting the first and second portions.

16. The method of claim 14 wherein said hinge comprises a single strip of resilient, self-restoring material.

17. The method of claims wherein said hinge comprises a hinge pin.

18. The method of claim 14 wherein the tube is secured in place in a roadside crash cushion, said roadside crash cushion comprising a central longitudinal axis, said tube positioned entirely on one side of said longitudinal axis.

19. The method of claim 18 wherein said crush axis and said longitudinal axis are substantially parallel.

20. The method of claim 18 wherein said compression axis defines a non-zero acute angle with respect to the longitudinal axis.

* * * * *

UNITED STATES PATENT AND TRADEMARK OFFICE

CERTIFICATE OF CORRECTION

PATENT NO. : 6,554,529 B2
APPLICATION NO. : 09/799905
DATED : April 29, 2003
INVENTOR(S) : Barry D. Stephens et al.

It is certified that error appears in the above-identified patent and that said Letters Patent is hereby corrected as shown below:

Col. 10, in claim 17, line 1, before "wherein" delete "claims" and substitute -- claim 14-- in its place.

Signed and Sealed this

Twenty-second Day of May, 2007

JON W. DUDAS
*Director of the United States Patent and Trademark Office*